United States Patent [19]

Mochimaru

[11] Patent Number: 4,535,982

[45] Date of Patent: Aug. 20, 1985

[54] SHEET FEEDING CASSETTE LATCHING SYSTEM

[75] Inventor: Hideaki Mochimaru, Yokohama, Japan

[73] Assignee: Ricoh Company, Ltd., Japan

[21] Appl. No.: 575,884

[22] Filed: Feb. 1, 1984

[30] Foreign Application Priority Data

| | | | |
|---|---|---|---|
| Feb. 1, 1983 | [JP] | Japan | 58-13767 |
| Feb. 7, 1983 | [JP] | Japan | 58-17424 |
| Feb. 10, 1983 | [JP] | Japan | 58-17445 |
| Apr. 4, 1983 | [JP] | Japan | 58-49891 |

[51] Int. Cl.[3] ..... B65H 1/08

[52] U.S. Cl. ..... 271/127; 271/157; 271/162

[58] Field of Search ..... 271/127, 162, 110, 157

[56] References Cited

FOREIGN PATENT DOCUMENTS

| | | | |
|---|---|---|---|
| 41462 | 3/1980 | Japan | 271/127 |
| 93743 | 7/1980 | Japan | 271/127 |

*Primary Examiner*—Richard A. Schacher
*Attorney, Agent, or Firm*—Guy W. Shoup

[57] ABSTRACT

A sheet feeding cassette latching system for latching on to a main body of a copying apparatus and the like a sheet feeding cassette including a sheet support plate for supporting a stack of sheets thereon, and an upper cover capable of being brought to an open position by flipping upwardly a rearward end thereof even when the cassette is in a latched position. When the cassette is in the latched position, the sheet support plate is moved upwardly by a lifter to bring a sheet pickup roller into pressing engagement with the uppermost sheet of the stack of sheets on the sheet support plate to feed one sheet after another to a copying station. The sheet feeding cassette is inserted into and withdrawn from the main body in a tilting position in which a rearward end thereof is located in a higher level than when the cassette is in the latched position. Transmission of power to the lifter from a drive source can be turned on and off in a conjunction with the operation of tilting the cassette and the operation of opening or closing the uppercover when the cassette is latched or unlatched. When power transmission is turned off, the sheet support plate in the sheet feeding position is moved downwardly by gravitational pull.

4 Claims, 12 Drawing Figures

SHEET FEEDING CASSETTE LATCHING SYSTEM

BACKGROUND OF THE INVENTION

This invention relates to a sheet feeding cassette latching system suitable for use in latching to a main body of a copying apparatus, for example, a sheet feeding cassette comprising a sheet support plate supporting a stack of sheets and pivotably held at its rearward end by a bottom plate of the cassette which is forced by a push-arm secured to a rotary shaft of the main body of the copying apparatus into pressing engagement with the uppermost sheet of the stack of sheets on the sheet support plate to feed one sheet after another to a copying station.

A sheet feeding cassette is usually used with an electrophotographic copying apparatus, printer, facsimile system, etc., as a device for feeding sheets, such as transfer-printing sheets, copy sheets, etc. Generally, such sheet feeding cassette which comprises a sheet support plate supporting a stack of sheets thereon and pivotably supported at its rearward end by a bottom plate of the cassette is latched on to a main body of the copying apparatus, for example, and the sheet support plate is forced to move upwardly by a pushup member of the copying apparatus to bring the uppermost sheet of the stack of sheets on the sheet support plate into pressing engagement with a pickup roller for picking up one sheet after another to feed same to a copying station. In this type of sheet feeding cassette, the sheet support plate is moved upwardly by applying pressure thereto by forcing the pushup member against the under-surface of the sheet support plate by the biasing force of a tension spring. When the sheet feeding cassette of this construction is latched on to the copying apparatus main body or unlatched, it is necessary to actuate a change-over lever or a cam located at one side of the cassette to temporarily move the pushup member away from the under-surface of the sheet support plate. Because of this, the sheet feeding cassette of the prior art has suffered the disadvantage that a shock of high magnitude and a noise of high level are produced when the cassette is introduced into the main body of the copying apparatus and the pushup member flips the sheet support plate of the cassette upwardly. In the type of cassette in which the pressure is released by means of the change-over lever, the operation is troublesome while a force of high magnitude is required for operating the lever and there is the disadvantage of the cassette or the main body of the copying apparatus suffering damage if an attempt is made to perform cassette latching or unlatching operation without releasing the pressure. In the type of cassette wherein the cam located at one side of the cassette is relied on, a force of considerably high magnitude is required for performing the cassette latching and unlatching operations, so that this type of cassette is lower in operability than the previously mentioned type of cassette. A sheet feeding pressure is produced as the load of the tension spring is applied between the sheets and the sheet feeding means. This pressure may vary depending on the displacement of the spring or the weight of the sheets, so that there is the disadvantage that a stable sheet feeding pressure is unobtainable depending on the volume of the stack of sheets on the sheet support plate or the size of the sheets.

When the cassette is replenished with sheets or the sheets in the cassette are replaced by sheets of different size or quality, it has hitherto been usual practice to unlatch the sheet feeding cassette from the main body of the copying apparatus. Thus, the sheet feeding cassettes of the prior art have generally been low in operability. To cope with this situation, a proposal has been made to use a sheet feeding cassette which comprises an upper cover that can be opened or closed while the cassette remains latched to the main body of the copying apparatus, and a sheet support plate pushup member which is operable in conjuction with the opening and closing operations of the upper cover to be separated from the sheet support plate to allow same to move downwardly to thereby provide a clearance between the sheet feeding means and the sheet support plate or the uppermost sheet of the stack of sheets placed thereon, so that sheets can be inserted through the clearance below the upper cover. In this case, a sheet feeding pressure is applied by means of a tension spring, so that a force of considerably high magnitude is required to perform upper cover opening and closing operations and cassette latching and unlatching operations. Also, a variation in the sheet feeding pressure is inevitable depending on the volume and size of the sheets placed on the sheet support plate.

SUMMARY OF THE INVENTION

An object of this invention is to provide a sheet feeding cassette latching system for a copying apparatus and the like which, obviating the aforesaid disadvantages of the sheet feeding cassettes of the prior art each having an upper cover and serving as a sheet feeding device, has a high degree of operability in replenishing the cassette or replacing the sheets contained in the cassette by sheets of different size or quality and latching the cassette on to the copying apparatus or unlatching same.

To accomplish the aforesaid object, the invention provides a sheet feeding cassette latching system comprising engaging members engageable with each other located at a forward end portion of a cassette at opposite sides thereof and a cassette receiving section of an apparatus to which the cassette is to be latched, the engaging members being operative to allow the cassette to move into and out of the cassette receiving section in a tilting position in which a rearward portion of the cassette is disposed at a higher-than-normal level while the cassette is in the poccess of being inserted into or withdrawn from the cassette receiving section and enable the cassette to move downwardly to a latched position when it has reached a predetermined position, a sheet support plate lifting member for moving upwardly a sheet support plate of the cassette, a drive source for actuating the sheet support plate lifting member, power transmission means that can be engaged or disengaged for transmitting power from the drive source to the sheet support plate, means for engaging and disengaging the power transmission means, and an actuating member engageable with the means for engaging and disengaging the power transmission means for actuating same, wherein the sheet support plate lifting member drive source, power transmission means and engaging and disengaging means are located on the apparatus to which the cassette is to be latched while the actuating member is located on the cassette and the actuating member is displaced with respect to the engaging and disengaging means in conjunction with the tilting movement of the cassette that takes place before the upper cover of the cassette is opened and the cassette is withdrawn from the cassette receiving section to thereby disengage the power transmission means.

By virtue of the features of the invention described hereinabove, latching and unlatching of the cassette and opening and closing the upper cover of the cassette for replenishing the cassette or replacing the sheets in the cassette with sheets of different size and quality can be performed without requiring an operation force of high magnitude and the noise produced when the sheet support plate lifting member flips the sheet support plate can be lessened.

In the construction of the sheet feeding cassette latching system described hereinabove, the lifting member and the sheet support plate are move downwardly by gravitational pull when the power transmission means is disengaged, thereby causing loosening of screws and production of noise by the impact of their downward movements.

Another object of the invention is to provide a sheet feeding cassette latching system which is provided with means for absorbing the shock of downward movements of the lifting member and the sheet support plate of the cassette without interfering with operations of associated parts when the power transmission means is actuated.

DESCRIPTION OF THE PREFERRED EMBODIMENTS

The invention will now be described by referring to the preferred embodiments thereof shown in the accompanying drawings.

Figure 1:
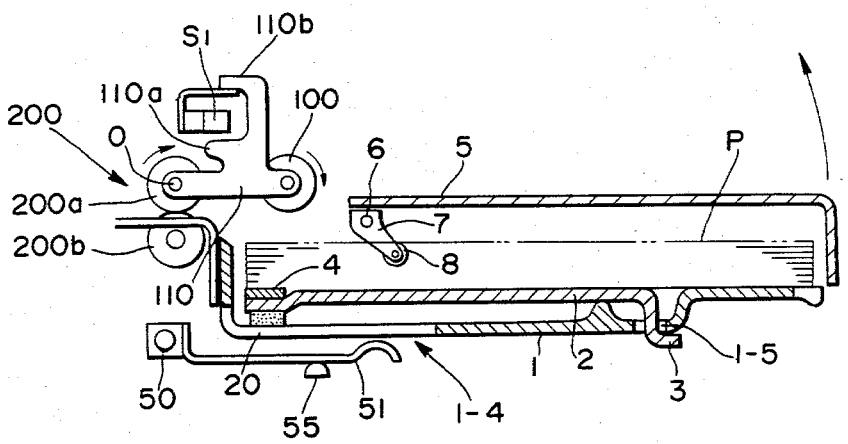
FIG. 1 is a vertical sectional view of the sheet feeding cassette latching system comprising one embodiment of the invention.
Figure 2:
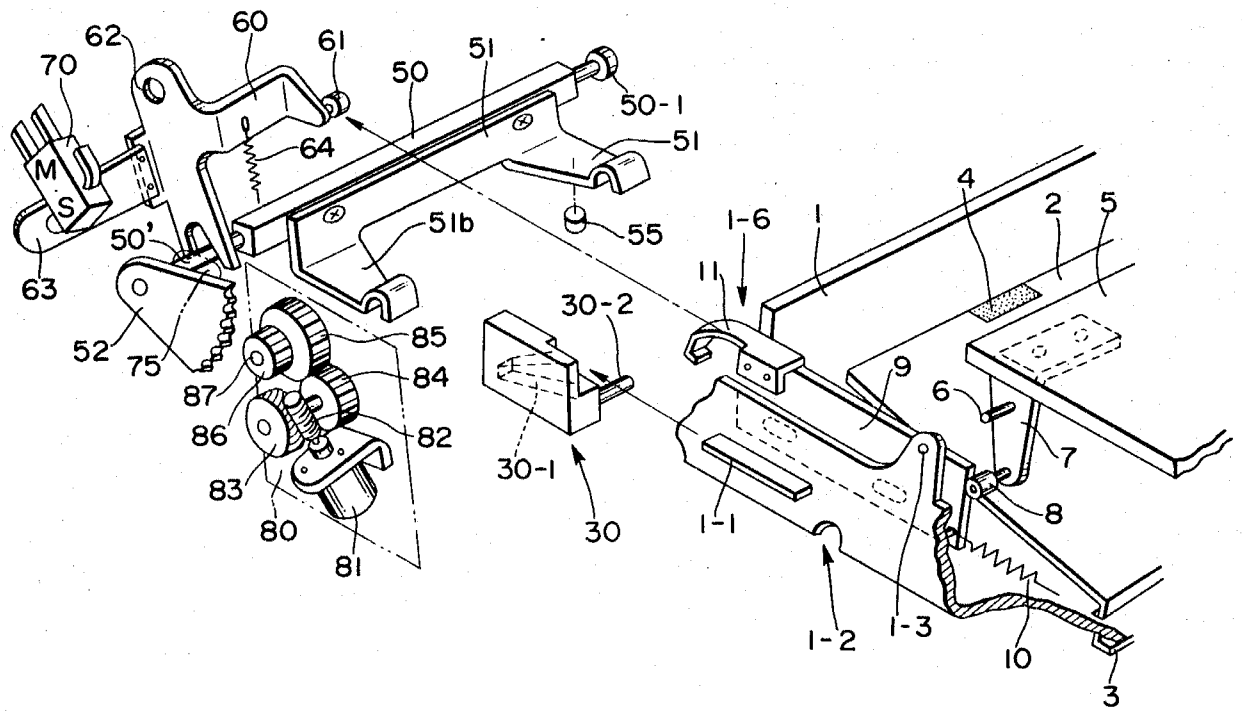
FIG. 2 is an exploded perspective view of the sheet feeding cassette latching system shown in FIG. 1.

Referring to FIGS. 1 and 2 which show one embodiment, a sheet feeding cassette 1 includes a sheet support plate 2 for supporting thereon a stack of sheets P which is bent at its rearward end portion to provide an engaging portion 3 received in a slit 1-5 formed in a bottom plate of the cassette 1 for pivotal movement. The sheet support plate 2 has a friction pad 4 attached to a forward end thereof in a position corresponding to a pickup roller 100 located above the cassette 1 at a left end portion thereof as seen in FIG. 1. The function of the friction pad 4 is to prevent a plurality of sheets from being picked up and fed by the pickup roller 100 at a time when the stack of sheets P on the sheet support plate 2 decrease in number, and this function of the friction pad 4 is performed by increasing the coefficient of friction between the friction pad 4 and the sheet as compared with that between the sheets themselves. The friction pad 4 and pickup roller 100 are equal to each other in width.

A cassette receiving section of a main body of an apparatus to which the cassette 1 to be latched (such apparatus will be described hereinafter as being a copying apparatus as an example) has a lifter 51 which moves in pivotal movement in conjunction with the rotary movement of a shaft 50. Rotation of the shaft 50 in a counterclockwise direction causes arms 51*a* and 51*b* at opposite sides of the lifter 51 to move upwardly through an opening 1-4 defined between the bottom plate and a front wall of the cassette 1 into engagement with the undersurface of the sheet support plate 2 to move same upwardly to bring the uppermost sheet of the stack of sheets P on the sheet support plate 2 into pressing engagement with the pickup roller 100. When a sheet feeding signal is issued, the pickup roller 100 rotates in the direction of an arrow in FIG. 1 to pick up and feed the uppermost sheet of the stack of sheets P. The pickup roller 100 which is supported at a forward end of a lever 110 supported by a shaft 0 is prevented from moving downwardly below a certain predetermined level by a stopper 110*b* formed at the lever 110. Supported by the shaft 0 is a roller 200*a* rotating in synchronism with the pickup roller 100 in the same direction which forms a pair of separation rollers 200 with another roller 200*b* in pressing engagement with the roller 200*a* for rotation only in a direction in which the sheet is pushed back toward the cassette 1. The lever 110 has a projection 110*a* serving as an actuator for actuating a sensor S1 when the pickup roller 100 is moved upwardly to a level suitable for performing sheet feeding.

A cover 5 serving as an upper cover of the cassette 1 for covering it expect for a forward end portion thereof is pivotable connected to the cassette 1 by hinge pins 6 each connected to one of hinge members 7 located on opposite sides of a forward end portion of the cover 5 and extending transversely for insertion in one of holes 1-3 formed on opposite sides of the cassette 1. Thus, the cover 5 can be moved from a closed position to an open position by holding its rearward end and flipping same upwardly in the direction of an arrow shown in FIG. 1. The cover 5 can be firmly held in the closed and open positions by a click stop mechanism, not shown. One of hinge members 7 has attached to its lower end portion a roller 8 which is in engagement with a rearward end of a slider 9 on one side of the cassette 1 which, being in engagement with one of opposite side plates of the cassette by a guide pin-slot arrangement for backward and forward sliding movement in a predetermined range, is urged by the biasing force of a spring 10 to move rearwardly. The slider 9 has attached to its forward end a cam 11 formed by bending a plate spring so as to be displaced resiliently.

Figure 3:
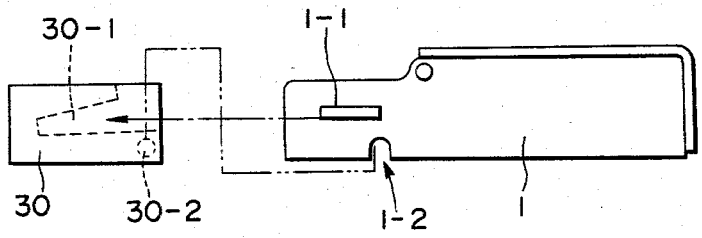
FIG. 3 is a side view of the engaging members located at the outside of the cassette and the main body of the apparatus to which the cassette is to be latched, respectively.

As shown in FIGS. 2 and 3, a rib 1-1 extending lengthwise of the cassette 1 is formed on either side thereof near its forward end and a recess 1-2 is formed at its lower edge. As the rib 1-1 and the recess 1-2 are fitted in a groove 30-1 and a guide pin 30-2 of a guide block 30 secured to a cassette mounting section of the copying apparatus, the cassette 1 is latched on to the copying apparatus in a predetermined position.

The shaft 50 of the lifter 51 is supported at a pivot 50-1 at one end thereof on one of opposite side plates of the copying apparatus, not shown, for swinging movement substantially in a horizontal plane about the pivot 50-1 and extends at the other end thereof through a slot 75 formed at the other side plate for swinging movement therein and for movement about its own axis. The end of the shaft 50 extending through the slot 75 has secured thereto a sector gear 52, as shown in FIG. 2. One side plate of the copying apparatus has connected thereto a drive unit 80 comprising a drive motor 81, a worm 82 supported on a shaft of the drive motor 81, a worm gear 83 meshing with the worm 82, a gear 84 rotating with the worm gear 83, and a gear 86 rotating with the gear 85 while being able to come into meshing engagement with the sector gear 52.

Figure 4:
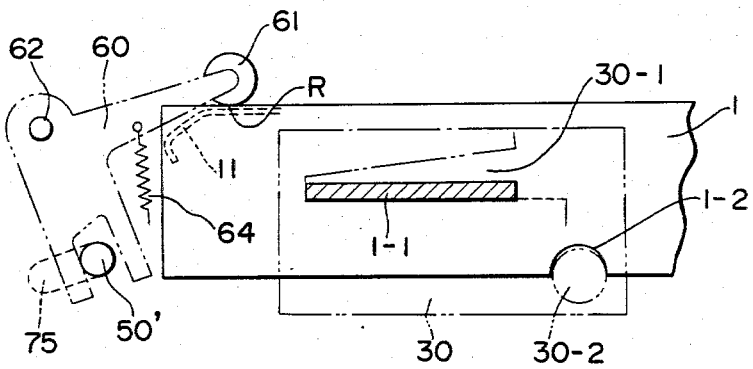
FIG. 4 is a side view of the cassette, showing the manner in which the engaging members shown in FIG. 3 are engaged and the condition in which the power transmission means engaging and disengaging means finds itself as the result of engagement of the engaging members when the cover is closed and the cassette is latched on to the main body of the apparatus.

A portion of the shaft 50 interposed between a portion for supporting the lifter 51 and the sector gear 52 is held between two legs of a bifurcated pivotal lever 60 supported by a shaft 62. The lever 60 includes an arm portion extending parallel to the shaft 50 and having a spring 64 connected thereto to urge the lever 60 to move in a clockwise direction about the shaft 62. The arm of the lever 60 has attached to its forward end a roller 61 with which an upper surface of the cam 11 attached to the forward end of the slider 9 of the cassette 1 is adapted to come into engagement. When the cover 5 of the cassette 1 is closed and the slider 9 has moved to a forward position, the roller 61 is moved upwardly by the cam 11 as shown in FIG. 4 and the lever 60 is pivotally moved through a certain angle in an anticlockwise direction against the biasing force of the spring 64 to move one end 50' of the portion of the shaft 50 held between the two legs of the bifurcated lever 60 in the slot 75 in a direction in which it draws near the cassette 1, until the sector gear 52 is brought into meshing engagement with the gear 86 of the drive unit 80 shown in FIG. 2. The lever 60 has attached to its forward edge opposite to the edge at which the arm is located a tongue 63 formed of plate spring which is disposed in juxtaposed relation to a microswitch 70 secured to the copying apparatus. When the lever 60 is moved in the counterclockwise direction as described hereinabove, the tongue 63 actuates the microswitch 70 before the sector gear 52 is brought into meshing engagement with the gear 86 to thereby actuate the motor 81. When the lever 60 further moves pivotally and the sector gear 52 comes into meshing engagement with the gear 86, the tongue 63 is restored to its original condition by its own resilience to thereby avoid damage to the switch 70 as well as the tongue 63 itself. As shown in FIG. 1, a cushion 20 is attached to a forward end portion of the bottom plate of the cassette 1 so that the forward end portion of the sheet support plate 2 can be prevented from suffering a shock when it hits the bottom plate in its downward movement. Also, a cushion 55 is attached to a machine frame in a position below the arm **51*a* near the pivot 50-1 of the shaft 50 of the lifter 51, as shown in FIG. 2, so that the lifter 51 can be prevented from suffering a shock when the lifter 51** moves downwardly.

In the sheet feeding cassette latching system of the aforesaid construction, when the cover 5 is closed after it is opened and the stack of sheets P are placed on the sheet support plate 2, the slider 9 is pressed at its rearward end by the roller 8 and moves forwardly against the biasing force of the spring 10 to slightly extend out of a cutout portion 1-6 of the cassette 1 and bring the rib 1-1 into engagement with the groove 30-1 at its upper surface in the guide block 30 while allowing the pin 30-2 to be fitted in the recess 1-2 to thereby latch the cassette 1 on to the copying apparatus in a predetermined position, as shown in FIG. 4. When the cassette 1 is set in the position, the cam 11 at the forward end of the cassette 1 moves the roller 61 upwardly and pivotally moves the lever 60 in the anticlockwise direction against the biasing force of the spring 64. This causes the tongue 63 to actuate the microswitch 70 to actuate the motor 81. Further pivotal movement of the lever 60 causes the shaft 50 held between the two legs of the lever 60 to move in swinging movement about the pivot 50-1 along with the lifter 51 while the sector gear 62 begins its meshing engagement with the gear 86. Since the motor 81 is already rotating at this time, the sector gear 52 and gear 86 are immediately brought into meshing engagement with each other as soon as their teeth are brought into contact with each other, thereby causing the lifter 51 to immediately start moving with the shaft 50 to move the sheet support plate 2 upwardly. As the uppermost sheet of the stack of sheets P on the sheet support plate 2 engages the pickup roller 100 and moves same upwardly to a predetermined level, the projection **110*a* of the lever 110 actuates the sensor S1 to render the motor 81 inoperative. Even if the motor 81 stops rotating, the sheet support plate 2 is held in position by the worm 82 and worm gear 83 in engagement with each other. As the copying operation is performed and the stack of sheets P becomes low in height, the projection 110*a* of the lever 110 is released from engagement with the sensor S1 which issues a signal to cause the motor 81 to rotate again. This brings the pickup roller 100 back to a predetermined elevated position again. By repeating the aforesaid operation, the uppermost sheet of the stack of sheets P and the pickup roller 100 can be maintained in predetermined relative positions at all times in which the sheet feeding pressure is kept constant at all times because it is determined by the weights of the pickup roller 100 and lever 110**.

When the stack of sheets P on the sheet support plate 2 are all fed to the printing station, sensor means, not shown, senses the absence of sheets on the sheet support plate 2 and stops the motor 81 while indicating that there is no sheet on the sheet support plate 2.

Then, the cover 5 of the cassette 1 is opened to move the roller 8 rearwardly to allow the slider 9 to be pulled back by the biasing force of the spring 10 to release the roller 61 from engagement with the cam 11 and move same downwardly to allow the lever 60 to be moved in the clockwise direction by the biasing force of the spring 64. As a result, the sector gear 52 is released from engagement with the gear 86 to allow the lifter 51 to be moved downwardly by gravitational pull along with the shaft 50 to the bottom of the cassette 1. At this time, the shock of downward movement of the lifter 51 is absorbed by the cushion 55 and no noise is produced. At the same time, the sheet support plate 2 also moves downwardly, and the shock of downward movement of the sheet support plate 2 is absorbed by the cushion 20. Thus, the tongue 63 is released from engagement with the microswitch 70. Thus, even if the motor 81 is rotated (when the cover 5 is opened while the sheet support plate 2 supports sheets thereon), the motor 81 is released from connection with its power source and stops rotating. Sheets can be supplied readily to the sheet support plate 2 which is spaced apart greatly from the pickup roller 100 through a large opening formed by the cover 5 in the open position.

Figure 5:
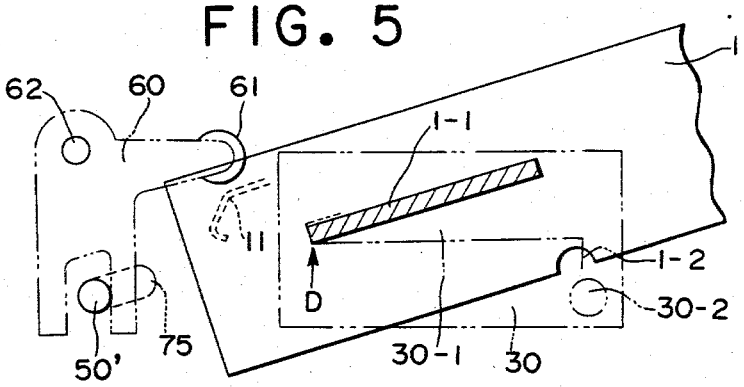
FIG. 5 is a side view similar to FIG. 4 but showing the cassette being tilted before being withdrawn from the main body of the apparatus to which it has been latched.

When it is desired to withdraw the cassette 1 from the copying apparatus and replace same by a new one, the following operation is performed. Prior to withdrawing the cassette 1, the rearward end of the cassette 1 is lifted, as shown in FIG. 5, into a tilting position in which the recess 1-2 at the lower edge of the side plate of the cassette 1 is released from engagement with the guide pin 30-2 of the guide block 30. As a result, the cassette 1 moves in pivotal movement in the anticlockwise direction with the forward end (point D in FIG. 5) of the rib 1-1 serving as a pivot until the top surface of the rib 1-1 is brought into contact with the upper side of the guide groove 30-1, and the cam 11 is displaced downwardly to allow the roller 61 to be released from engagement with the cam 11 and enable the pivotal lever 60 to move in pivotal movement in the clockwise direction about the shaft 62 until the end 50′ of the shaft 50 abuts against a left end of the slot 75 when the lever 60 stops moving in pivotal movement. The aforesaid operation causes the lifter 50 to move downwardly which results in the sheet support plate 2 also moving downwardly to provide a clearance between the uppermost sheet of the stack of sheets P and the pickup roller 100, so that the cassette 1 can be readily withdrawn by moving the top surface of the rib 1-1 along the upper side of the guide groove 40-1. As described hereinabove, the lifter 51 can be readily moved downwardly by the simple operation of tilting the cassette 1 before withdrawing same from the copying apparatus. In latching the cassette 1 on to the copying apparatus, the cassette 1 is held in a tilting position by the guide groove 30-1 while being inserted into the cassette receiving section of the copying apparatus and returned to a horizontal position when it is latched on to the copying apparatus in a predetermined position. By this operation, the cam 11 is brought into engagement with the roller 61 to allow the lifter 51 to move upwardly. Thus, latching of the cassette 1 on to the copying apparatus can be effected readily without requiring a force of high magnitude.

When the sector gear 52 and gear 86 are released from meshing engagement with each other, the lifter 51 is supported on the cushion 55 in a lowermost or standby position shown in FIG. 1. Thus, when the lever 60 moves in pivotal movement to allow the shaft 50 to move in swinging movement about the pivot 40-1 as the cassette 1 is being latched on to the copying apparatus or the cover 5 of the cassette 1 is being closed, the undersurface of the arm 51*a* of the lifter 51 moves in sliding movement along the top surface of the cushion 55.

The cushion 20 merely performs the function of absorbing the shock of downward movement of the sheet support plate 2. However, the cushion 55 should perform the function of not only absorbing the shock of downward movement of the lifter 51 but also the sliding movement of the lifter 51 on its top surface. Thus, it is necessary that the cushion 55 be mounted in a suitable position and have its shape and quality adjusted to suit the condition of use.

In the embodiment shown and described hereinabove, the cushion 55 is located in the vicinity of the pivot of swinging movement 50-1 of the shaft 50. By this arrangement, it is possible to reduce the distance covered by the swinging movement of the shaft 50 while the lifter 51 is maintained in sliding engagement at its bottom surface with the cushion 55 at its top surface, so that the force required for moving the lever 60 in pivotal movement can be lessened by reducing the moment produced by the resistance to the sliding movement of the lifter 51 on the cushion 55. The cushion 55 is shaped such that its forward end is hemispherical to reduce the sliding area. As for the material, the cushion 55 may be simply formed integrally with synthetic rubber of a rubber hardness number of 40–70. However, the use of a multilayer structure for the cushion 55 in which the cushion 55 has a sheet of low friction coefficient attached to the sliding surface at the forward end and a foamed material located in the lower portion satisfactorily serves the purpose. An air damper or spring may be used in combination with the cushion 55.

Figure 6:
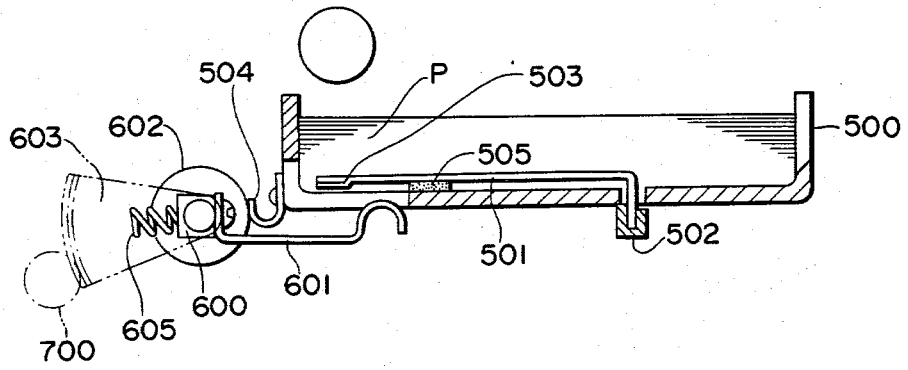
FIG. 6 is a vertical sectional view of the sheet feeding cassette latching system comprising another embodiment.
Figure 7:
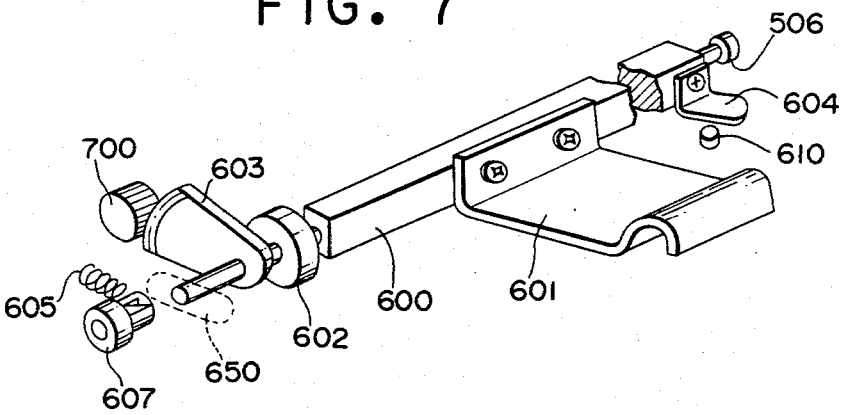
FIG. 7 is a perspective view of the sheet feeding cassette latching system shown in FIG. 6.

FIGS. 6 and 7 shows another enbodiment in which a sheet feeding cassette 500 has a sheet support plate 501 for supporting a stack of sheets P thereon which is provided with a friction pad 503 at its forward end and supported for pivotal movement through a dislodging preventing member 502. The cassette 500 also has a bottom plate which has a cushion 505 on its top surface in a position below the forward end of the sheet support plate 501.

The cassette 500 has attached to its forward end an actuating member 504 formed by bending a plate spring in a manner to have a J-shaped cross-sectional shape. The J-shaped actuating member 504 is positioned such that, when the cassette 500 is latched on to a copying apparatus, it presses against a roller 602 connected to one end of a shaft 600 to which a sheet support plate lifting member 601 is secured pressing against the shaft 600. Secured to the shaft 600 to act as a unit therewith is a sector gear 603 which is in meshing engagement with a drive gear 700 driven by a motor, not shown. The shaft 600 is supported for swinging movement about a pivot 506 at one end (the right end in FIG. 7) and for rotation about its own axis, and an end portion of the shaft 600 opposite the pivot 506 which supports the roller 602 and sector gear 603 is journalled by a bearing 607 in a slot 650 formed in a side plate of a main body of the copying apparatus. The bearing 607 is urged to move rightwardly in FIG. 7 by a compression coil spring 605. An angle member 604 is secured to the shaft 600 in the vicinity of the pivot 506 for the swinging movement of the shaft 600, and a cushion 601 is located beneath the angle member 604. When no cassette is latched on to the copying apparatus, the shaft 600 is urged by the biasing force of the spring 605 into engagement with a right end of the slot 650 and the sector gear 603 is released from meshing engagement with the drive gear 700, so that the shaft 600 is subjected to a moment of force exerted by the weight of the lifting member 601 in a clockwise direction and held in a position in which the angle member 604 is supported at its bottom surface by the cushion 610 at its top surface.

When the cassette 500 is latched on to the copying apparatus, the actuating member 504 presses against the roller 602 to move the shaft 600 in swinging movement about the pivot 502 at one end of the shaft 600 and to bring the sector gear 603 into meshing engagement with the drive gear 700. At this time, the drive gear 700 is rotated in the clockwise direction by the drive source, not shown, so that the lifting member 601 moves the sheet support plate 501 upwardly.

When the cassette 500 is unlatched, the bearing 607 is moved rightwardly in FIG. 7 by the biasing force of the spring 605 in the slot 650 and the sector gear 700 is released from meshing engagement with the gear 603, to allow the lifting member 601 to be moved downwardly by gravitational pull. At this time, the angle member 604 strikes the cushion 610 and the shock of impact is lessened and the production of a noise is avoided. The angle member 604 and cushion 610 are located in the vicinity of the pivot 502 of swinging movement of the shaft 600. This is conducive to a reduction in the distance covered by the swinging movement of the shaft 600 while the undersurface of the angle member 604 is in contact with the top surface of the cushion 610, so that it is possible to reduce the moment of force exerted on the pivot 502 of swinging movement of the shaft 600 by friction.

For the friction pad attached to the forward end portion of the sheet support plate of the cassette to perform the desired function, it is necessary that the forward end portion of the underside of the stack of sheets placed on the sheet support plate be forced against the top surface of the friction pad by the pickup roller with a force of sufficiently high magnitude. To this end, it has hitherto been usual practice in sheet feeding cassettes of the prior art to arrange the friction pad in such a manner that its top surface is flush with the surface of the sheet support plate or projects slightly upwardly to keep its top surface parallel with the top surface of the sheet support plate.

In sheet feeding cassettes of the type with which the invention is concerned in which the cassette can be replenished while being latched on to the copying apparatus by flipping the rearward end of the cover upwardly, the sheets supplied to the cassette are moved forwardly in sliding movement on the sheet support plate of the cassette until they reach a front wall thereof, the forward end of the sheets would catch against the friction pad if the latter projects upwardly, even if slightly, with a result that the sheets might be prevented from moving forwardly or broken at the leading end. It would be necessary to perform a time-consuming operation to work on the friction pad to make it perfectly flush with the top surface of the sheet feeding plate.

Figure 8:
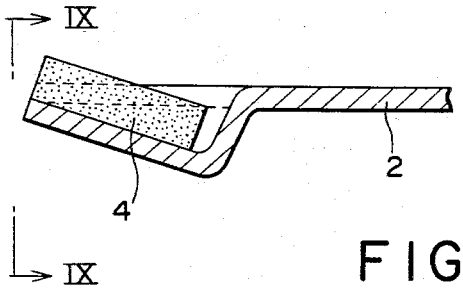
FIG. 8 is a sectional side view of the friction pad used in combination with the sheet feeding cassette latching system according to the invention and parts located in its vicinity.
Figure 9:
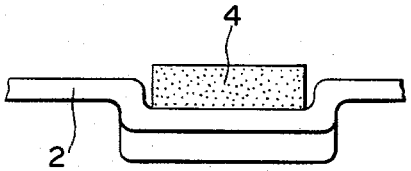
FIG. 9 is a front view as seen in the direction of arrows IX—IX in FIG. 8.

To avoid this disadvantage, the friction pad or cushion 4 may be arranged in a tilting position as shown in FIGS. 8 and 9 in such a manner that an end of the top surface of the cushion 4 located on the upstream side with respect to the direction of movement of the sheets fed is located in a position lower than the top surface of sheet support plate 2 and the top surface of the cushion is located in a position higher than the top surface of the sheet support plate 2 at the opposite end. By this arrangement, it is possible to bring the bottom surface of the sheets into pressing engagement with the top surface of the cushion 4 positively even if no precision finishes are given to the cushion 4 and to smoothly supply the sheets to the cassette by allowing same to slide on the top surface of the sheet support plate from under the cover of the cassette.

Generally, in a copying apparatus in which a cassette is latched on to the cassette receiving section of the main body and unlatched as desired, it is inevitable that a gap is defined between an opening of the apparatus for receiving the cassette and the top surface of the cassette. However, the presence of such gap might result in a sheet jam caused by a document or a sheet with an image printed thereon carelessly placed on the cover of the cassette and inadvertently moved down into the apparatus. To avoid this trouble, it has hitherto been usual practice to provide the forward end edge of the cassette cover with an upwardly extending projection for preventing sheets or other foreign matter from inadvertently entering the apparatus.

However, the provision of this projection has no effect in solving the problem in a sheet feeding cassette of the type with which the invention is concerned in which the rearward end of the cassette is lifted to bring the cassette into a tilting position in which the rib on the side wall of the cassette is inserted in the guide groove of the apparatus to effect insertion or withdrawing of the cassette. If the cassette of this type were provided with an upwardly extending projection at its forward end, such projection would strike those parts of the apparatus which are located above the cassette or a developing device, for example, while being inserted into the cassette receiving section, thereby making it impossible to insert the cassette into a latched position. It would be necessary to increase the size of the gap above the cassette if such trouble were to be avoided.

Figure 10:
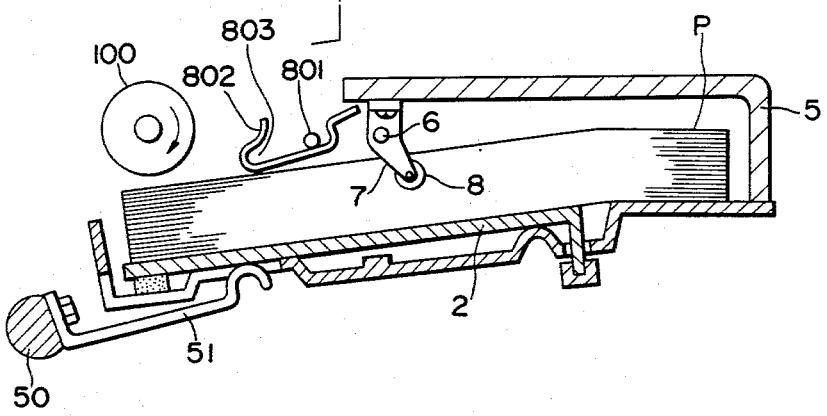
FIG. 10 is a vertical sectional view of one example of the sheet feeding cassette provided with a foreign matter receiver suitable for use in combination with the sheet feeding cassette latching system according to the invention.
Figure 11:
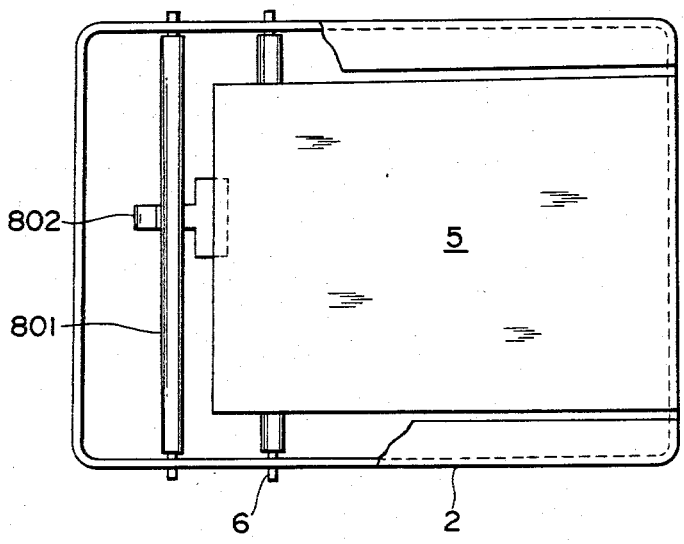
FIG. 11 is a plan view of the sheet feeding cassette shown in FIG. 10.

FIGS. 10 and 11 show an embodiment which solves this problem. In the figures, parts similar to those shown in FIG. 1 are designated by like reference characters.

A swinging shaft 801 swingably supported at opposite ends by two side plates of the cassette 2 in a position below and forwardly of the forward end edge of the cover 5 of the cassette 1 has joined as by welding to the substantially central portion thereof a receiver 802 in the form of a letter T as seen from above and in the form of a letter J as seen from the side which is positioned such that a hook 803 receives a sheet sliding downwardly from the top surface of the cover 5, as shown in the drawings. The receiver 802 is urged to move downwardly by gravitational pull or by means of a suitable spring in such a manner that the hook 803 hangs down into pressing engagement with the uppermost sheet of the stack of sheets on the sheet support plate 2 in a position slightly forwardly of the shaft 801. The receiver 802 is positioned such that a rearward end thereof is located slightly rearwardly of the forward end edge of the cover 5 so that the rearward end of the receiver 802 will be positioned against the forward end portion of the undersurface of the cover 5 when the cover 5 is closed and the sheet support plate 2 moves downwardly to bring the hook 803 of the receiver 802 out of engagement with the uppermost sheet of the stack of sheets on the sheet support plate 2.

Thus, when the sheet support plate 2 is moved upwardly by the lifter 51 to a sheet feeding position in which the uppermost sheet of the stack of sheets on the sheet support plate 2 is brought into pressing engagement with the pickup roller 100, the receiver 802 moves in swinging movement about the swinging shaft 801 in a clockwise direction to bring the hook 803 to a position in which it advantageously receives a sheet or the like that might move downwardly from the top surface of the cover 5. It is essential that when the receiver 802 is in this position, its uppermost portion does not extend above the top surface of the cover 5 when the latter is closed. By this arrangement, sheets or other foreign matter that might move downwardly from the cover 5 are caught by the hook 803 of the receiver 802 and prevented from entering the apparatus. When the cassette 1 is withdrawn from the apparatus, the receiver 802 does not strike those parts of the apparatus which are located above the cassette even if the rear portion of the cassette is lifted, thereby enabling the cassette to be smoothly withdrawn from the apparatus.

When the cover 5 of the cassette 1 is opened after the cassette 1 has been latched on to the apparatus to replenish the cassette or manually supply sheets, the rearward end portion of the receiver 802 is pushed downwardly by the undersurface of the forward end portion of the cover 5 and the hook 803 is prevented from moving downwardly by its own weight. Thus, combined with the downward movement of the sheet support plate 2, this creates a sufficiently large gap between the top surface of the sheet support plate 2 or the stack of sheets thereon and the receiver 802 to allow the sheets to move smoothly therein without being blocked by the receiver 802.

Figure 12:
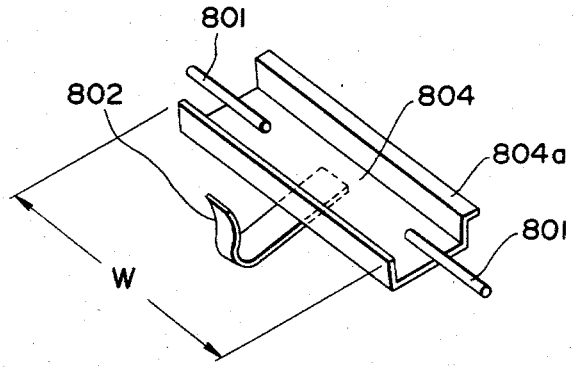
FIG. 12 is a perspective view of another example of the receiver shown in FIG. 10.

In a copying apparatus of the type in which a developing unit is mounted or removed by moving same along the top surface of the cover 5 of the sheet feeding cassette 1 latched on to the main body of the copying apparatus, toner might be scattered from the developing unit while the latter is being inserted or withdrawn and slide down along the top surface of the cover 5 in a forward direction until it drops on to the uppermost sheet of the stack of sheets on the sheet support plate 2 or the top surface of the sheet support plate 2 to soil the sheets or the interior of the cassette 1. To avoid this trouble, a receiver 804 of a groove shape extending through the entire width W of the cover 5 may be supported by the swinging shaft 801, as shown in FIG. 12. The receiver 804 is formed at the central portion of its forward end with the hook 802 for catching sheets or the like and at its rearward end edge with a flange 804*a* reaching the undersurface of the forward end edge of the cover 5. By using the receiver 804 of this shape, it is possible to catch sheets as well as minuscule particles, such as toner, which might slide downwardly along the top surface of the cover 5. In this constructional form of receiver, the positions of the upper end of the hook and the center of gravity of the receiver can be decided in the same manner as the constructional form thereof shown in FIGS. 10 and 11. Also, by mounting a magnet in the receiver 803, foreign matter of magnetic nature can be positively caught by the receiver 804.

From the foregoing description, it will be appreciated that according to the invention, the displacement of the cam causes the lifter and the sheet support plate of the cassette to move downwardly both when the cover of the cassette is opened or closed and when the cassette is latched on to a desired apparatus or unlatched, so that the sheet support plate can be replenished or the sheets on the sheet support plate can be replaced by other sheets and the cassette can be replaced by another cassette positively without requiring an operation force of high magnitude. Also, according to the invention, when the sheet support plate of the cassette moves downwardly, the shock of downward movement of the lifter can be absorbed by a cushion member, thereby avoiding loosening of screws and production of noises by the impact of collision of the lifter with the parts located in the cassette receiving section of the main body of the copying apparatus. At the same time, the risk of the parts associated with the movements of the sheet support plate of the cassette being interfered with by the lifter during operation can be avoided.

What is claimed is:

1. A sheet feeding cassette latching system capable of latching a sheet feeding cassette on to a main body of a copying apparatus and the like and unlatching same comprising a sheet support plate pivotally supported at a rearward end portion thereof by a bottom plate of the cassette, and an upper cover capable of being opened and closed as a rearward end thereof is flipped upwardly even when the cassette is in a latched position, said sheet support plate being pivotally moved upwardly by a lifter of the main body when the cassette is inserted into the latched position to bring the uppermost sheet of a stack of sheets supported on the sheet support plate into pressing engagement with sheet feeding means of the main body to feed one sheet after another to a copying station, such system comprising:

engaging members engageable with each other located at a forward end portion of the cassette at opposite sides thereof and a cassette receiving section of the main body, said engaging members being operative to allow the cassette to be moved into and out of the cassette receiving section in a tilting position in which a rearward portion of the cassette is disposed at a higher-than-normal level while the cassette is in the process of being inserted into or withdrawn from the cassette receiving section and enable the cassette to move downwardly to the latched position when it has reached a predetermined position;

a sheet support plate lifter drive source for moving said lifter upwardly;

power transmission means which can be engaged and disengaged for transmitting power from said sheet support plate lifter drive source to said lifter;

engaging and disengaging means for engaging and disengaging said power transmission means; and an actuating member for actuating said engaging and disengaging means by being brought into engagement therewith;

wherein said sheet support plate lifter drive source, power transmission means and engaging and disengaging means are located at the main body while said actuating member is located at the cassette and said actuating member is operative in conjunction with both the operation of opening the upper cover of the cassette and the operation of tilting the cassette when the cassette is to be unlatched to cause the engaging and disengaging means to bring the power transmission means to a disengaged condition so that the lifter and the sheet support plate of the cassette can be moved by gravitational pull from the sheet feeding position and the sheet feeding means is brought out of engagement with the uppermost sheet of the stack of sheets when there are sheets on the sheet support plate or a top surface of the sheet support plate when there are no sheets thereon.

2. A sheet feeding cassette latching system as claimed in claim 1, wherein said actuating member located at the cassette is slidable with respect to a side wall of the cassette in a predetermined range in cassette inserting and withdrawing directions and moved forwardly against the biasing force of a spring by a member extending forwardly of a forward end of the upper cover when the latter is closed to move the cassette to the latched condition, and when the cassette has been brought to the latched condition, a cam located at a forward end of the actuating member is brought into engagement with said engaging and disengaging means to thereby bring the power transmission means to an engaged condition.

3. A sheet feeding cassette latching system as claimed in claim 1 or 2, wherein said power transmission means comprises a first gear secured to one end of a shaft of said lifter, and a second gear driven by said sheet support plate lifter drive source through a worm and a worm gear into and out of meshing engagement with said first gear; said lifter is pivotably supported at an end of the shaft opposite to the end at which the first gear is supported; and said engaging and disengaging means for the power transmission means comprises a member for pivotally moving the shaft of the lifter in such a manner that said first and second gears are brought into and out of meshing engagement with each other.

4. A sheet feeding cassette latching system capable of latching a sheet feeding cassette on to a main body of a copying apparatus and the like and unlatching same comprising a sheet support plate pivotably supported at a rearward end portion thereof by a bottom plate of the cassette, and an upper cover capable of being opened and closed as a rearward end thereof is flipped upwardly even when the cassette is in a latched position, said sheet support plate being pivotally moved upwardly by a lifter of the main body after the cassette is inserted into the latched position to bring the uppermost sheet of a stack of sheets supported on the sheet support plate into pressing engagement with sheet feeding means of the main body to feed one sheet after another to a copying station, such system comprising:

means for allowing the cassette to be inserted into and withdrawn from the main body in a tilting condition in which a rearward end thereof is higher than when the cassette is in the latched position;

a drive source located at the main body for moving said lifter upwardly;

power transmission means located at the main body which can be engaged and disengaged for transmitting power from said drive source to said lifter; and engaging and disengaging means located at the main body for engaging and disengaging said power transmission means;

said power transmission means comprising:

a first gear secured to one end of a shaft of said lifter; and a second gear driven by said sheet support plate lifter drive means through a worm and a worm gear into and out of meshing engagement with said first gear; and said engaging and disengaging means comprising:

a member for causing said shaft of the lifter to move in swinging movement to bring said first and second gears into and out of meshing engagement with each other; and a cushion member located in the vicinity of the pivot of swinging movement of said shaft of the lifter for receiving an arm of the lifter moving downwardly when said first and second gears are brought out of meshing engagement with each other, said cushion member being shaped such that the area of contact between the cushion member and a bottom surface of the arm of the lifter can be reduced in size.

* * * * *